United States Patent [19]

Negishi

[11] Patent Number: 4,876,860

[45] Date of Patent: Oct. 31, 1989

[54] REFRIGERATOR WITH VARIABLE VOLUME INDEPENDENTLY COOLED STORAGE CHAMBERS

[75] Inventor: Kozaburo Negishi, Isesaki, Japan

[73] Assignee: Sanden Corporation, Gunma, Japan

[21] Appl. No.: 200,733

[22] Filed: May 31, 1988

[51] Int. Cl.[4] ..... F25D 17/06

[52] U.S. Cl. ..... 62/179; 62/186; 62/329

[58] Field of Search ..... 62/179, 186, 187, 329, 62/326, 465; 236/13

[56] References Cited

U.S. PATENT DOCUMENTS 2,534,272 12/1950 Kleist ..... 62/329
3,027,732 4/1962 Mann et al. ..... 62/329 X
3,108,452 10/1963 Breen ..... 62/187
4,027,727 6/1977 Pullens .
4,467,618 8/1984 Gidseg ..... 62/329 X

*Primary Examiner*—Harry B. Tanner
*Attorney, Agent, or Firm*—Banner, Birch, McKie & Beckett

[57] ABSTRACT

A refrigerator with a plurality of storage chambers is disclosed. The interior of the refrigerator is divided into at least two chambers by an adjustable shelf. An air passageway is formed by a gap between the refrigerator cabinet and an inner separation member. Air is circulated past an evaporator through the air passageway and into each storage chamber. Air collected from each storage chamber passes over the evaporator after flowing through a connecting hole in the rear of the inner separation member.

12 Claims, 2 Drawing Sheets

REFRIGERATOR WITH VARIABLE VOLUME INDEPENDENTLY COOLED STORAGE CHAMBERS

BACKGROUND OF THE INVENTION

1. Technical Field

This invention relates to a refrigerator, and more particularly, to a refrigerator provided with a plurality of variable volume storage chambers each of which has independent temperature control.

2. Description of Related Art

Generally, foodstuffs have predetermined storage temperatures to maintain their freshness. Storing conditions for foodstuffs are usually divided into three temperature zones, such as a freezing zone (stored below −18° C.), a chilled zone (stored below 0° C.±2° C.) and a refrigerating zone (stored below 5° C.±2° C.). Therefore, known refrigerators are generally provided with at least two chambers each of which store different types of foodstuffs under different temperature zones. However, conventional refrigerators are constructed as fixed structures. The volume of each chamber for storing food is fixed and can not change in accordance with changing food storage demands.

SUMMARY OF THE INVENTION

It is a primary object of this invention to provide a refrigerator with a plurality of variable volume storage chambers maintained under different temperature conditions.

It is another object of this invention to provide a refrigerator with a plurality of storage chambers wherein the volume of each chamber may be readily and easily modified using a simple construction.

A refrigerator according to the invention has a cabinet with a front opening which is normally closed by a hinged door. The refrigerator includes a plurality of variable volume storage chambers. An inner separation member is disposed in the cabinet to define a storage chamber and an air passageway between the cabinet and the inner separation member. The air passageway allows closed air circulation from end openings of the air passageway through the storage chamber and into a connecting hole at the center portion of the rear of the separation member. An evaporator for refrigeration is disposed midway in the air passageway and cools air moving out of the connecting hole on the rear of the separation member. The storage space defined by the inner separation member is horizontally divided into a plurality of storage chambers by adjustable partitions. Each storage chamber connects with the connecting hole thereby allowing closed air circulation from the plurality of storage chambers through the connecting hole and into the evaporator. Individual temperature controls are provided so that the temperature in each variable volume storage chamber may be controlled independently.

Further objects, features and other aspects of this invention will be understood from the following detailed description of the preferred embodiments referring to the attached drawings.

DETAILED DESCRIPTION OF THE INVENTION

Figure 1:
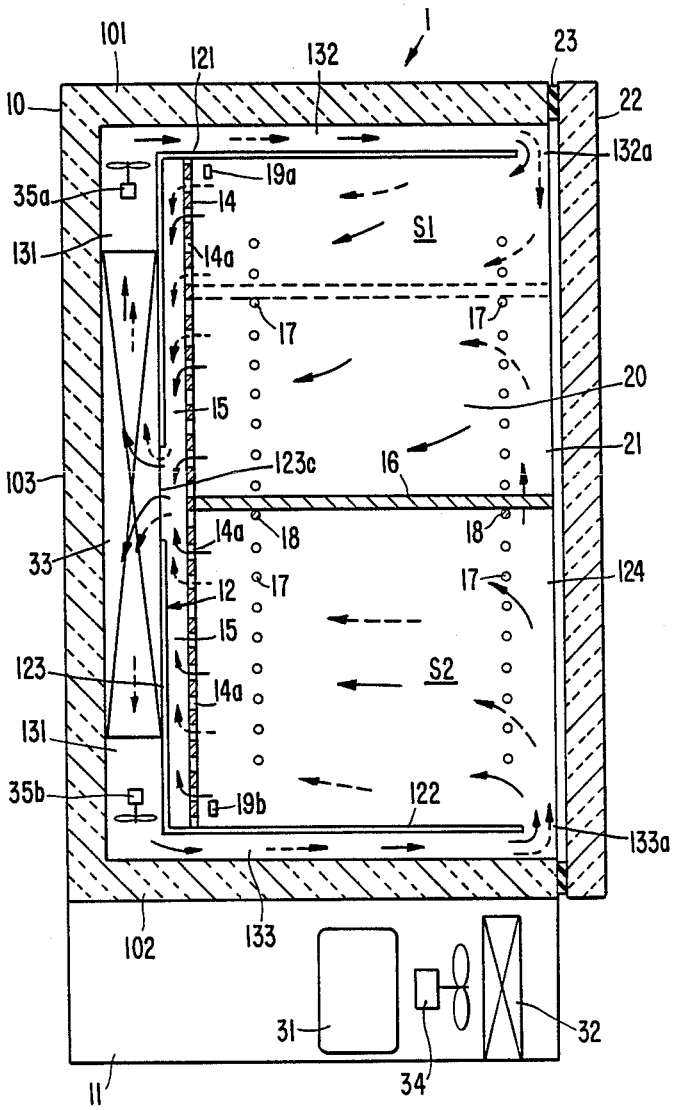
FIG. 1 is a cross sectional view of a refrigerator in accordance with a first embodiment of this invention.

FIG. 1 shows a refrigerator in accordance with a first embodiment of this invention. Refrigerator 1 comprises cabinet 10 with interior space 20, front opening 21, and mechanical chamber 11 placed below cabinet 10. The interior space 20 of cabinet 10 is defined by upper panel 101, bottom panel 102, rear panel 103 extending outwardly to connect between upper and bottom panels 101, 102, and two side panels (not shown). Each panel is made of an insulating material. Front opening 21 is normally closed by hinged door 22. A gap between cabinet 10 and door 22 is sealed by sealing element 23.

An inner separation member 12 is disposed within cabinet 10 defining inner storage space S. Separation member 12 is formed of upper element 121, bottom element 122, rear element 123 extending upwardly to connect between upper and bottom elements 121, 122, and two side elements (one of which is indicated by numeral 124). Connecting hole **123*c* is formed through the center portion of rear element 123 to allow air flow between storage space S and rear space 131, rear space 131 being defined between rear panel 103 and rear element 123**.

A vertical plate element 14 is disposed in separation member 12 adjacent to rear element 123. Plate element 14 and rear element 123 thus form air communication way 15 between front storage space S and rear space 131. Plate element 14 is provided with a plurality of flow holes **14*a*. Flow holes 14*a* provide communication between space S and communication way 15, which in turn communicates with rear space 131 through connecting hole 123*c***.

Storage space S is horizontally divided into two storage chambers S1 and S2 by partition 16 which is adjustably disposed in separation member 12. The position of partition 16 is determined by the position of support pins 18 which are adjustably affixed in holes 17 formed on each side of separation member 12. In the preferred embodiment, partition 16 not only divides storage space S into chambers but also acts as a shelf. In an alternative embodiment, partition 16 can divide storage space S vertically, rather than horizontally. With changing food storage demands, partition 16 allows the size of the storage chambers to be easily adjusted. An alternative position for partition 16 is illustrated by the dashed lines in the FIGS. 1 and 2.

A space 132 is defined between upper panel 101 and upper element 121. Space 132 is open to upper storage chamber S1 at one end **132*a*. At the other end, space 132 is connected to rear space 131. Likewise, a space 133 is defined between bottom panel 102 and lower element 122. Space 133 is open to lower storage chamber S2 at one end 133*a*. At the other end, space 133 is connected to rear space 131**.

Air circulation is therefore possible by air in upper storage chamber S1 flowing into rear space 131 via air communication way 15, continuing through hole **123*c* and returning to the chamber S1 after passing through the portion of the air passageway formed by upper space 132. Likewise, air in lower storage chamber S2 can be circulated through rear space 131 and bottom space 133 in a similar manner as air in upper storage chamber S1**.

Refrigerator 1 is provided with a refrigerating means which comprises a compressor 31, a condenser 32 and an evaporator 33 to cool the air in the refrigerator. Compressor 31 and condenser 32 are disposed in mechanical chamber 11. Mechanical chamber 11 is vented by fan 34. Evaporator 33 is disposed in rear space 131, while allowing unrestricted air flow from connecting hole 123c. Fans 35a and 35b are disposed in upper and lower portions of rear space 131, respectively, to cause forced air circulation. Each fan 35a and 35b is controlled in accordance with the detected signal from its respective thermal element 19a or 19b disposed in each of the respective chambers S1 and S2. Therefore, the temperature in each chamber S1 and S2 is maintained below a predetermined level in accordance with the operation of fan 35.

In operation, when door 22 is closed to seal opening 21 of cabinet 10, the two chambers S1 and S2 are also sealed and isolated from one another. During refrigeration, when a storage chamber has reached its desired predetermined temperature, for example upper chamber S1, fan 35a is shut off in accordance with the detected signal from thermal element 19. Thus, the forced air circulation within upper chamber S1 ceases.

Figure 2:
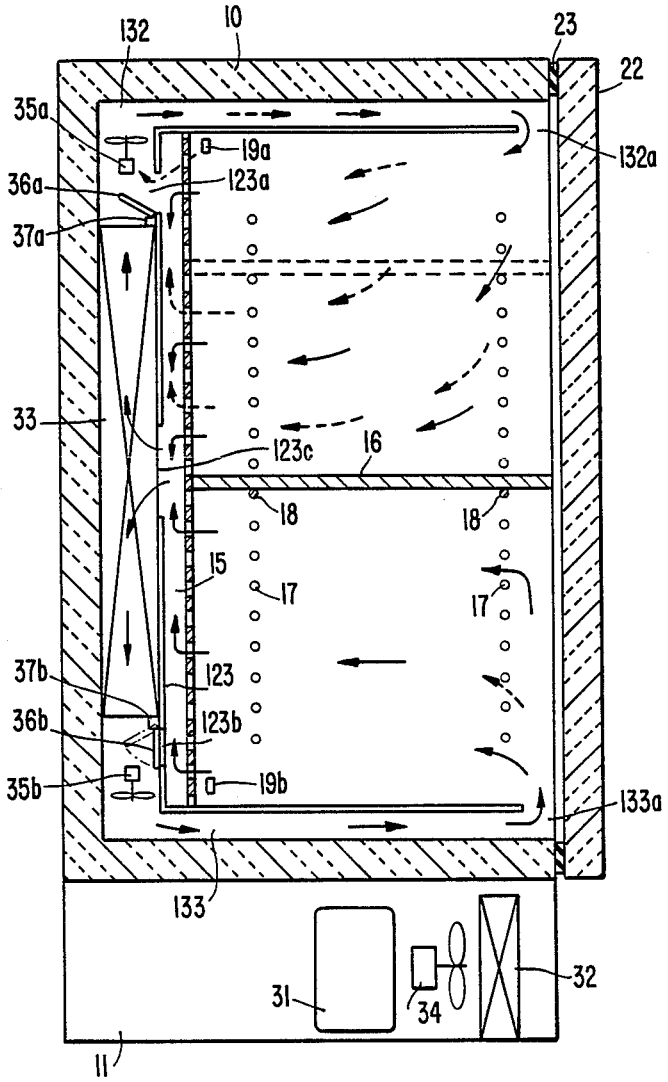
FIG. 2 is a cross sectional view of a refrigerator with damper doors in accordance with a second embodiment of this invention.

FIG. 2 shows a second embodiment of the invention wherein the air connection between air communication way 15 and rear space 131 is modified to include a damper door, thereby providing more precise control of temperature in the storage chambers.

Penetration holes 123a and 123b are formed through the upper and lower portions of rear element 123 of separation member 12 and are positioned beyond, i.e., above and below, respectively, evaporator 33, as shown. The opening and closing of each hole 123a and 123b is controlled by damper doors 36a and 36b, respectively, rotatably attached on rear element 123. The positions of damper doors 36a and 36b are controlled by electric motors 37a and 37b, respectively. Electric motors 37a and 37b respond to the signal from respective thermal element 19a or 19b, respectively, for control of the temperature in the storage chamber. An example of suitable electric motors 37 and damper doors 36 is disclosed in U.S. Pat. No. 4,633,677.

When the temperature of a chamber S1, for example, sensed by thermal sensor 19a exceeds a predetermined desired temperature, damper door 36a for that chamber is fully closed to cover hole 123a. Conversely, when the temperature sensed by thermal sensor 19a is below the predetermined desired temperature, damper door 36a is fully opened to thereby block airflow from evaporator 33. In these instances, fan 35a is continuously on to keep forced air circulation and maintain a uniform storage chamber temperature. Independent control of damper door 36b by motor 37b in response to temperature sensed by thermal sensor 19b is also possible.

Damper doors 36a and 36b can also independently operate stepwise to control air mixtures. The mixing ratio between cooled air passed out of evaporator 33 and the air introduced from holes 123a or 123b can be adjusted according to the slat angle of damper door 36a or 36b, respectively. When the temperature of a chamber S1, for example, sensed by thermal sensor 19a is about 4° to 5° C. above the predetermined desired temperature, damper door 36a is fully closed to cover hole 123a. When the temperature sensed by thermal sensor 19a is between the predetermined desired temperature and about 4° or 5° C. above the predetermined desired temperature, damper door 36a is stepwise rotated by electric motor 37a to adjust the air flow through hole 123a. When the temperature sensed by thermal sensor 19a is below the predetermined desired temperature, damper door 36a is fully opened to block air flow out of evaporator 33. In these instances as well, fan 35a is continuously on to keep forced air circulation. Independent stepwise control of chamber door 36b by motor 37b in response to temperature sensed by thermal sensor 19b is also possible. Thus, the temperature in the storage chamber can be more precisely maintained below a predetermined level.

This invention has been described in detail in connection with its preferred embodiments. These embodiments, however, are exemplary and the invention is not intended to be restricted thereto. It will be recognized by those of skill in the art that other variations and modifications can be made within the scope of this invention, as defined by the appended claims.

What is claimed is:

1. A refrigerator with at least two variable volume, independently cooled storage chambers comprising:
   - a cabinet with a front opening;
   - a door element hinged on said cabinet to normally close the front opening;
   - an inner separation member disposed within the cabinet to define a storage space;
   - one or more adjustable partitions for dividing said storage space into at least two variable volume, independently cooled storage chambers;
   - flow control means associated with each variable volume, independently cooled storage chamber for controlling air flow into each of said variable volume, independently cooled storage chambers;
   - connecting hole means formed through said inner separation member for allowing air flow from said variable volume, independently cooled storage chambers;
   - refrigerating means comprising an evaporator disposed adjacent to said connecting hole means to cool air from the variable volume, independently cooled storage chambers so that air from each variable volume, independently cooled storage chamber can be cooled by flowing through said connecting hole means and over said evaporator; and
   - an air flow space formed by disposing said inner separation member within the cabinet with a gap between said inner separation member and the cabinet so that air cooled by flowing over said evaporator can selectively flow under control of said flow control means through the air flow space and selectively into each of the variable volume, independently cooled storage chambers.

2. The refrigerator with a plurality of variable volume, independently cooled storage chambers of claim 1, said flow control means including a fan associated with each of said variable volume, independently cooled storage chambers, said fans being disposed in said air flow space for selectively controlling the air flow into each of the variable volume, independently cooled storage chambers, said fans being located downstream of said evaporator and causing forced air circulation.

3. The refrigerator with a plurality of variable volume, independently cooled storage chamber of claim 2, said flow control means further including a thermal element mounted in each of said variable volume, independently cooled storage chambers, each said fan being responsive to said thermal element mounted in said variable volume, independently cooled storage chamber associated with said fan.

4. The refrigerator with a plurality of variable volume, independently cooled storage chambers of claim 3, at least one partition being capable of acting as a shelf.

5. The refrigerator with a plurality of variable volume, independently cooled storage chamber of claim 2 further comprising:

an opening associated with each storage chamber formed through said inner separation member at a position downstream of said evaporator to allow air to flow between said storage chambers and said air flow space;

said flow control means further including a damper disposed at each said opening for controlling the flow of air through said opening to said air flow space.

6. The refrigerator with a plurality of variable volume, independently cooled storage chambers of claim 5, at least one partition being capable of acting as a shelf.

7. The refrigerator with a plurality of variable volume, independently cooled storage chambers of claim 1 further comprising a plate having a plurality of flow holes, said plate being disposed adjacent said separation member so that air from each of the variable volume, independently cooled storage chambers can flow through the flow holes in said plate and through said connecting hole means.

8. The refrigerator with a plurality of variable volume, independently cooled storage chamber of claim 7 further comprising:

an opening associated with each storage chamber formed through said inner separation member at a position downstream of said evaporator to allow air to flow between said storage chambers and said air flow space;

said flow control means further including a damper disposed at each said opening for controlling the flow of air through said opening to said air flow space.

9. The refrigerator with a plurality of variable volume, independently cooled storage chambers of claim 8, at least one partition being capable of acting as a shelf.

10. The refrigerator with a plurality of variable volume, independently cooled storage chambers of claim 7, said flow control means including a fan associated with each of said variable volume, independently cooled storage chambers, said fans being disposed in said air flow space for selectively controlling the air flow into each of the variable volume, independently cooled storage chambers, said fans being located downstream of said evaporator and causing forced air circulation.

11. The refrigerator with a plurality of variable volume, independently cooled storage chambers of claim 10, said flow control means further including a thermal element mounted in each of said variable volume, independently cooled storage chambers, each said fan being responsive to said thermal element mounted in said variable volume, independently cooled storage chamber associated with said fan.

12. The refrigerator with a plurality of variable volume, independently cooled storage chambers of claim 10, at least one partition being capable of acting as a shelf.

* * * * *